US008626019B2

(12) United States Patent
Amemiya et al.

(10) Patent No.: US 8,626,019 B2
(45) Date of Patent: Jan. 7, 2014

(54) POWER SWITCH STRUCTURE AND IMAGE FORMING APPARATUS INCLUDING SAME

(75) Inventors: Kanae Amemiya, Tokyo (JP); Hiroshi Ishii, Kanagawa (JP); Toshihiro Shimada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 13/064,895

(22) Filed: Apr. 25, 2011

(65) Prior Publication Data

US 2011/0280608 A1 Nov. 17, 2011

(30) Foreign Application Priority Data

May 14, 2010 (JP) ..... 2010-112703

(51) Int. Cl.
*G03G 15/00* (2006.01)

(52) U.S. Cl.
USPC ..... 399/88

(58) Field of Classification Search
USPC ..... 399/88, 124
See application file for complete search history.

(56) References Cited

U.S. PATENT DOCUMENTS

| | | | | |
|---|---|---|---|---|
| 4,635,010 | A * | 1/1987 | Miyai et al. | 399/108 |
| 6,486,419 | B2 * | 11/2002 | Horiguchi et al. | 200/43.19 |
| 6,507,720 | B2 | 1/2003 | Kabumoto et al. | |
| 6,647,223 | B2 | 11/2003 | Ishii | |
| 6,898,407 | B2 | 5/2005 | Noguchi et al. | |
| 6,937,838 | B2 | 8/2005 | Ishii et al. | |
| 6,975,830 | B2 | 12/2005 | Murakami et al. | |
| 7,016,629 | B2 | 3/2006 | Ishii et al. | |
| 7,174,121 | B2 | 2/2007 | Kuma et al. | |
| 7,181,152 | B2 | 2/2007 | Kuma et al. | |
| 7,184,684 | B2 | 2/2007 | Murakami et al. | |
| 7,215,907 | B2 | 5/2007 | Fukuchi et al. | |
| 7,263,309 | B2 | 8/2007 | Noguchi et al. | |
| 7,275,808 | B2 | 10/2007 | Katsuyama et al. | |
| 7,292,817 | B2 | 11/2007 | Murakami et al. | |
| 7,333,749 | B2 | 2/2008 | Noguchi et al. | |
| 7,400,851 | B2 | 7/2008 | Kuma et al. | |
| 7,406,283 | B2 | 7/2008 | Noguchi et al. | |
| 7,454,157 | B2 | 11/2008 | Yamada et al. | |
| 7,469,981 | B2 | 12/2008 | Katsuyama et al. | |
| 7,606,521 | B2 | 10/2009 | Noguchi et al. | |
| 7,620,345 | B2 | 11/2009 | Ishii et al. | |
| 7,706,727 | B2 | 4/2010 | Kuma et al. | |
| 7,873,297 | B2 | 1/2011 | Andoh et al. | |

(Continued)

FOREIGN PATENT DOCUMENTS

| | | | |
|---|---|---|---|
| JP | 7296680 | A | 11/1995 |
| JP | 3570878 | A | 8/1999 |

(Continued)

OTHER PUBLICATIONS

Chinese Office Action for corresponding Chinese application No. 201110129942 dated Jun. 20, 2013.

*Primary Examiner* — Quana M Grainger
(74) *Attorney, Agent, or Firm* — Harness, Dickey & Pierce P.L.C.

(57) ABSTRACT

A power switch structure for an apparatus, including a recess provided in a side surface of the apparatus and having a distal sloped face facing a front side of the apparatus and a proximal sloped face surface, and a power switch, inclined with respect to the side surface of the apparatus, positioned on the distal sloped face surface to face the front side of the apparatus.

20 Claims, 7 Drawing Sheets

(56) References Cited

U.S. PATENT DOCUMENTS

| | | | |
|---|---|---|---|
| 2002/0009310 | A1 | 1/2002 | Kabumoto et al. |
| 2002/0041775 | A1 | 4/2002 | Ishii |
| 2002/0056630 | A1 | 5/2002 | Horiguchi et al. |
| 2004/0052560 | A1 | 3/2004 | Ishii et al. |
| 2004/0126150 | A1 | 7/2004 | Noguchi et al. |
| 2004/0208676 | A1 | 10/2004 | Ishii et al. |
| 2005/0008393 | A1 | 1/2005 | Kuma et al. |
| 2005/0036810 | A1 | 2/2005 | Murakami et al. |
| 2005/0084293 | A1 | 4/2005 | Fukuchi et al. |
| 2005/0169653 | A1 | 8/2005 | Noguchi et al. |
| 2005/0226657 | A1 | 10/2005 | Kuma et al. |
| 2005/0281594 | A1 | 12/2005 | Kuma et al. |
| 2006/0024103 | A1 | 2/2006 | Murakami et al. |
| 2006/0120763 | A1 | 6/2006 | Ishii et al. |
| 2007/0059036 | A1 | 3/2007 | Yamada et al. |
| 2007/0092290 | A1 | 4/2007 | Murakami et al. |
| 2007/0098455 | A1 | 5/2007 | Kuma et al. |
| 2007/0127946 | A1 | 6/2007 | Noguchi et al. |
| 2007/0196152 | A1 | 8/2007 | Shimizu et al. |
| 2007/0242976 | A1 | 10/2007 | Noguchi et al. |
| 2008/0025751 | A1 | 1/2008 | Andoh et al. |
| 2008/0240799 | A1 | 10/2008 | Noguchi et al. |
| 2009/0074494 | A1 | 3/2009 | Katsuyama et al. |
| 2010/0177361 | A1 | 7/2010 | Amemiya |
| 2010/0232822 | A1 | 9/2010 | Takenaka et al. |

FOREIGN PATENT DOCUMENTS

| | | | | |
|---|---|---|---|---|
| JP | 2000-0275923 | | | 10/2000 |
| JP | 2000275923 | A | | 10/2000 |
| JP | 2005192289 | A | * | 7/2005 |
| JP | 2007183677 | A | | 7/2007 |
| JP | 200821436 | A | | 1/2008 |
| JP | 2008-059768 | | | 3/2008 |
| JP | 2008216377 | A | | 9/2008 |

* cited by examiner

POWER SWITCH STRUCTURE AND IMAGE FORMING APPARATUS INCLUDING SAME

CROSS-REFERENCE TO RELATED APPLICATIONS

This patent specification claims priority from Japanese Patent Application No. 2010-112703, filed on May 14, 2010 in the Japan Patent Office, the entire contents of which are hereby incorporated by reference herein.

BACKGROUND OF THE INVENTION

1. Field of the Invention

The present invention relates to a power switch structure, and an image forming apparatus including the power switch structure.

2. Description of the Background

Multi-function machines combining two or more of copying, printing, and facsimile functions are widely used as image forming apparatuses. At present, in image forming apparatuses, such as printers, it is preferable that the power switch be provided where the user can easily see and operate it. However, due to limitations imposed by the mechanical layout in the interior of the printer, or in order to avoid the power switch from being turned off unintentionally, the power switch is not always provided on the front side of the printer. In addition, a configuration in which the power switch is provided on the front side of the printer may not always be desirable.

In order to avoid the power switch from being operated unintentionally, it may be preferable that the power switch be disposed on one side of the apparatus, as shown, for example, in FIG. 1. In FIG. 1, reference numeral 1 represents a printer body, 2 represents the side of the printer body, and 4 represents the power switch. Yet even here, in a case in which the power switch is disposed on a lateral side of the printer as shown in FIG. 1, the power switch may still be unintentionally operated, which does not solve the above-described problem of accidental operation.

It may be possible to provide the power switch in a recessed position recessed from the surface of the printer. However, when the power switch 4 is disposed at recessed position on the side of the apparatus, it can be difficult for the user to find the power switch 4 from front side of the printer. That is, it becomes hard to see the power switch 4, thus complicating its proper operation.

For example, as shown in FIGS. 2A and 2B, a square recess 3 is formed in a part of the side surface 2 of the printer body 1, and a power switch 4A is provided on a bottom surface 31 of the square recess 3 inside the square recess 3. With such a configuration, users are less likely to see the power switch 4A along a line of sight 6.

In addition, as shown in FIG. 3, in a case in which a square recess 3*a* is formed in the side surface 2 of the apparatus 1 and a power switch 4B is disposed on a distal surface 32 of the square recess 3*a*, depending on the type of switch and the depth of the square recess 3*a* it can be difficult to operate the power switch 4B. That is, ordinarily, the user's finger is obliquely inserted into the square recess 3*a* and the user has not so much difficulty in operating a push-type power switch. However, in a case in which the power switch 4B is constructed of what is called rocker type, (or tumbler type), the user is less likely to move the finger because the user's finger is obliquely inserted into the square recess 3*a*, degrading the operability of the power switch 4B.

SUMMARY OF THE INVENTION

This specification describes below an improved fixing device. In one exemplary embodiment of the present invention, a power switch structure for an apparatus, including a recess provided in a side surface of the apparatus and having a distal sloped face facing a front side of the apparatus and a proximal sloped face surface, and a power switch, inclined with respect to the side surface of the apparatus, positioned on the distal sloped face surface to face the front side of the apparatus.

Another embodiment of the present invention provides an image forming apparatus that includes, an apparatus body, a recess, having a distal sloped face facing a front side of the apparatus and a front face, provided in one side of the apparatus body, and a power switch, inclined with respect to the side surface of the apparatus body, provided on the distal sloped face of the recess and facing the front side of the apparatus body.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
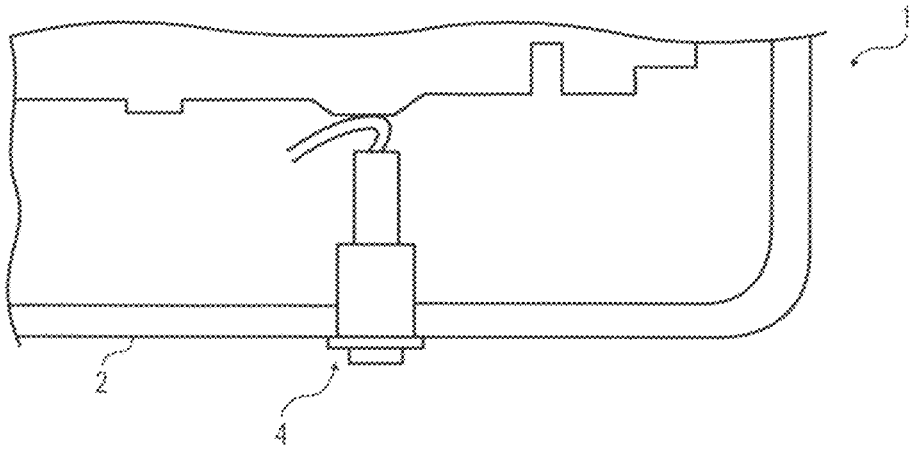
FIG. 1 RELATED ART
FIG. 1 is a cross-sectional view illustrating a vicinity of a power switch provided on a side surface of a printer according to a related art example.
Figure 2A:
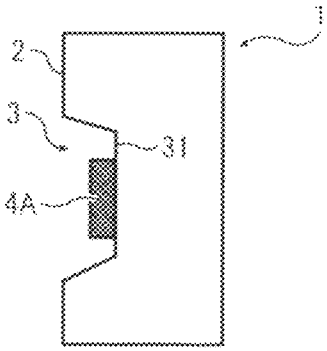
FIG. 2A RELATED ART
FIGS. 2A and 2B are expanded cross-sectional views illustrating a vicinity of a power switch provided on a bottom surface of a square recess formed in a side surface of a printer according to another related art example.
Figure 2B:
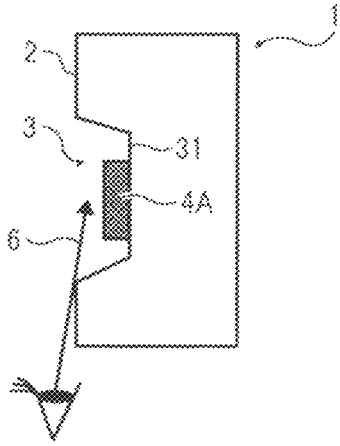
FIG. 2B RELATED ART
Figure 3:
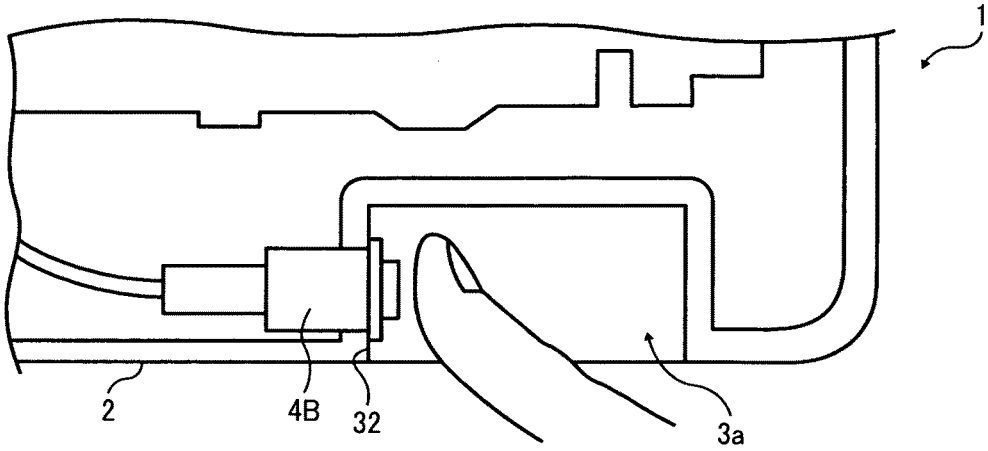
FIG. 3 RELATED ART
FIG. 3 is a cross-sectional view illustrating a vicinity of a power switch provided on a side surface of square recess formed in a side surface of a printer according to another related art example.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 4:
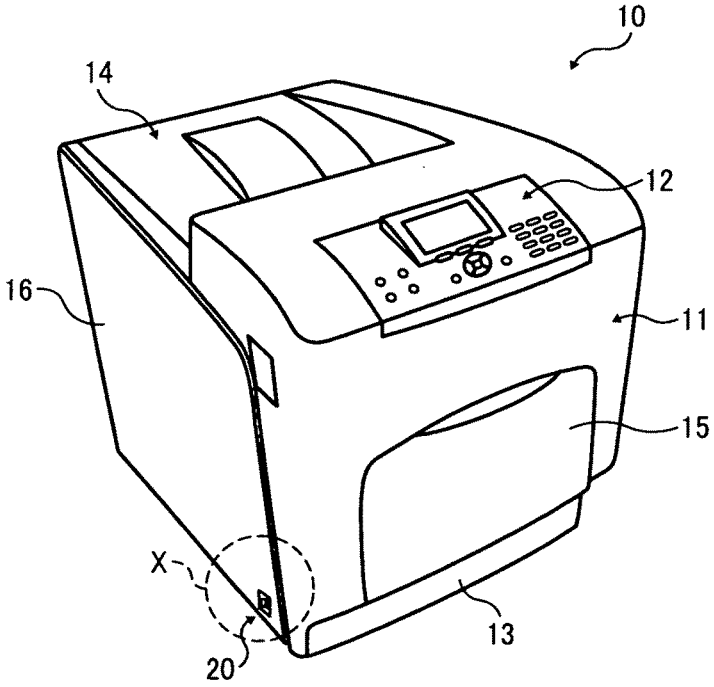
FIG. 4 is a schematic perspective diagram illustrating a printer according to a first illustrative embodiment.

Referring now to the drawings, wherein like reference numerals designate identical or corresponding parts throughout the several views thereof, and particularly to FIG. 4, an image forming apparatus according to an illustrative embodiment of the present invention is described. In this embodiment, the image forming apparatus is a multicolor printer (hereinafter referred to as a printer). It is to be noted that although the image forming apparatus of the present embodiment is a printer, the image forming apparatus of the present invention is not limited to a printer. Therefore, for example, the image forming apparatus may be a copier, facsimile machine, plotter, multi-function machine, or the like.

FIG. 4 is a schematic perspective diagram illustrating an image forming apparatus 10. The printer 10 includes a printer body (apparatus body) 11, an operating device 12, a feed tray 13 contained in the printer body 11, a discharge tray 14 positioned on an upper surface of the printer body 11, a front cover 15 that covers a front surface of the printer body 11, and a power switch 20. Reference numeral 16 represents a left side surface of the printer body 11. Although below describes the configuration in which the power switch 20 is provided in a part X of the left side surface 16 of the printer body 11, the position of the power switch 20 is not limited on the left side surface 16, the power switch 20 can be provided on a right side surface of the printer body 11.

Figure 5A:
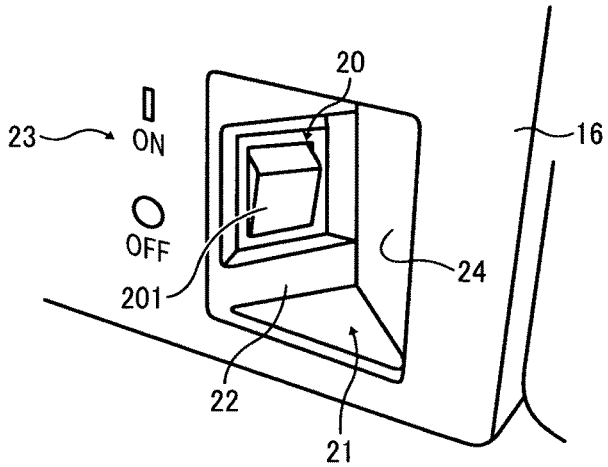
FIG. 5A is an expanded perspective view illustrating a vicinity of a power switch according to the first illustrative embodiment shown in FIG. 4.

As shown in FIG. 5A, in vicinity X of the power switch 20, a recess 21 is formed in the left side surface (hereinafter simply "side surface") 16 of the printer body 11, such that the recess 21 has a distal sloped surface 22 that faces a front side of the printer body 11. The recess 21 further has a proximal sloped surface 24, an upper surface, and a lower surface. It is preferable that the recess 21 be V-shape. The distal sloped surface 22 and the proximal sloped surface 24 are recessed from the side surface 16, and are inclined to the side surface 16 as an external material of the printer body 11. The power switch 20 is provided on the distal sloped surface 22 that faces the front side of the printer body 11. That is, the power switch 20 is inclined to the side surface 16 of the printer body 11.

A reference numeral 23 is a status indicator indicating the state in which the power switch 20 is on state or off state. The status indicator 23 may be formed of indictor or indicating using lamp.

Figure 5B:
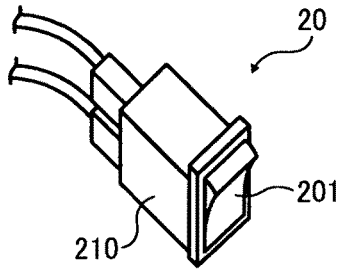
FIG. 5B is an exploded perspective view illustrating the power switch shown in FIG. 5A.

FIG. 5B is an exploded perspective view illustrating the power switch 20. In FIG. 5B, the power switch 20 of the present embodiment is a so-called "rocker switch" or "tumbler switch". A rocker switch is an on/off switch that rocks (rather than trips) when pressed, which means one side of the switch is raised while the other side is depressed. An operation portion 201 of the power switch 20 pivots on a rotary shaft (center support) thereof, not shown, in the recess 21 in a vertical or an almost vertical direction of the printer body 11.

Herein, an example of a configuration of the power switch 20 is described below in detail.

Figure 6B:
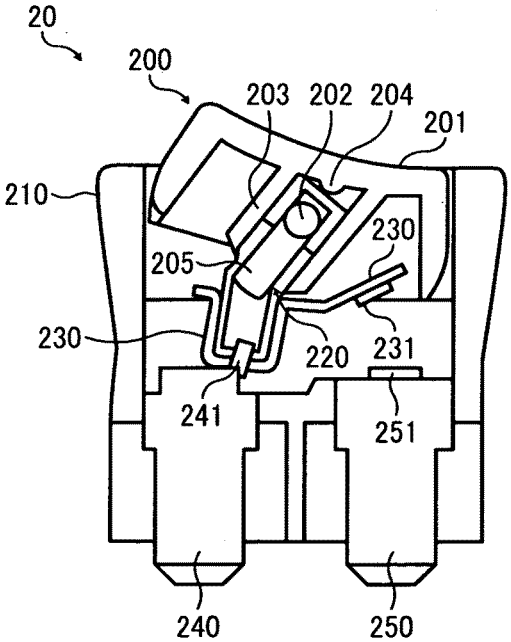
FIGS. 6A and 6B are cross-sectional views illustrating the power switch shown in FIG. 5B.
Figure 6A:
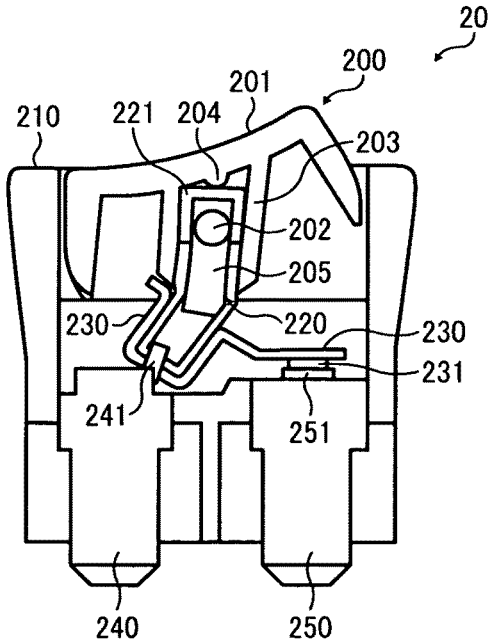

FIGS. 6A and 6B are cross-sectional views of the power switch 20 shown in FIG. 5B. In FIGS. 6A and 6B, the power switch 20 includes a handle 200, a peripheral wall 210, two coil springs 220, a pivotable plate 230, and support terminals 240 and 250. The handle 200 includes the operation portion 201, a rotary shaft 202, a holding tube 203, a semicircular projection 204, and a pressing protrusion 205. The rotary shaft 202 is engaged with a support member on an interior wall of the peripheral wall 210, and the handle 200 of the power switch 20 can be pivoted around the rotary shaft 202, with respect to the peripheral wall 210.

Both sides of upper ends of the coil springs 220 are engaged with an upper lib 221, and lower ends of the coil springs 220 are engaged with a fulcrum point 241 provided on an upper face of the support terminal 240.

A movable contacting portion 231 is provided on a lower face of one end of the pivotable plate 230 that is formed of an electro-conductive metal plate, and the movable contacting portion 231 contacts and separates from a fixed contacting portion 251 provided on an upper face of the support terminal 250. When the movable contacting portion 231 contacts the fixed contacting portion 251, the support terminals 240 and 250 conduct electricity to each other, that is, the power switch 20 is on state (see FIG. 6A).

In a state in which the movable contacting portion 231 contacts the fixed contacting portion 251 shown in FIG. 6A, a repulsion force of the coil springs 220 transmits the upper lib 221 and the coil springs 220 boost the semicircular projection 204 via the upper lib 221, which causes the handle 200 to pivot around the rotary shaft 202.

When a right end of the operation portion 201 is pressed, the handle 200 is pivoted rightward, and a lower end of the holding tube 203 presses a middle of the coil spring 220 leftward. In a state in which the handle 200 is at a middle position (center position) within a pivoting range, an upper base of the holding tube 203 of the handle 200 and the fulcrum point 241 supporting the pivotable plate 230 becomes smallest, and the coil spring 220 is pressed such that the length of the coil spring 220 is smallest. Thus, when the handle 200 is pivoted rightward over the middle position, the repulsion force of the coil spring 220 is exerted to the handle 200 via the upper lib 221 such that the handle 200 is pivoted rightward, and the power switch 20 becomes off state as shown in FIG. 6B. FIG. 6B shows the power switch 20 in a state in which the movable contacting portion 231 is separated from the fixed contacting portion 251, that is, the power switch 20 is off state.

Figure 7A:
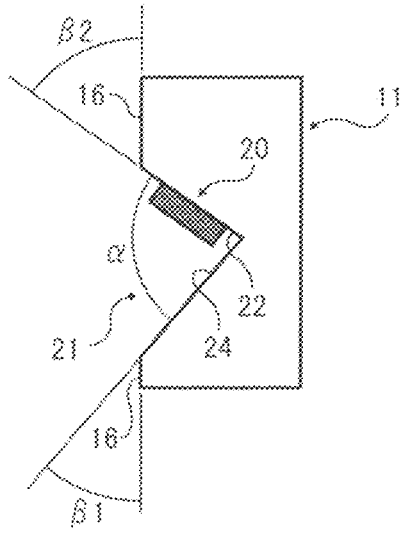
FIGS. 7A and 7B are cross-sectional views illustrating the vicinity of the power switch.

FIG. 7A shows an opening angle $\alpha$ in opening of the recess 21, an inclined angle $\beta 1$ formed by the side surface 16 of the printer body 11 and the proximal sloped surface 24, and an inclined angle $\beta 2$ formed by the side surface 16 and the distal sloped surface 22.

Figure 7B:
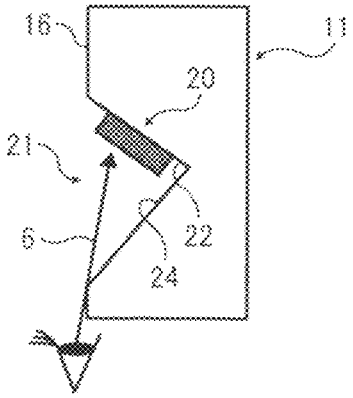

As shown in FIG. 7B, in the line of sight 6 of the user, these angles $\alpha$, $\beta 1$, and $\beta 2$ are such that the power switch 20 can be seen from the front side of the printer body 11.

Although the angle $\beta 2$ formed by the distal sloped surface 22 and the side surface 16 is set greater than the angle $\beta 1$ formed by the proximal sloped surface 24 and the side surface 16 in the configuration shown in FIG. 7A, the configuration in the present embodiment is not limited to the relation of angles, for example, the angles $\beta 1$ and $\beta 2$ may be set equal.

Figure 8A:
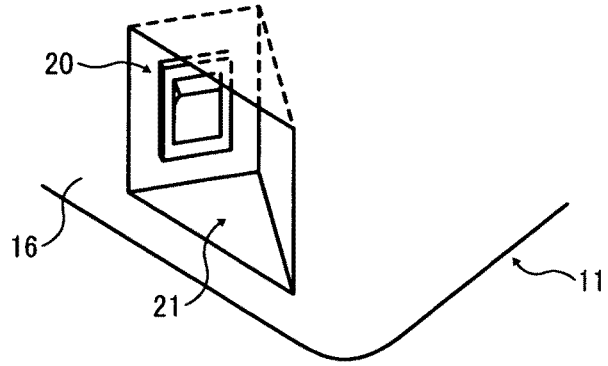
FIG. 8A is a perspective view illustrating vicinity of the power switch.
Figure 8B:
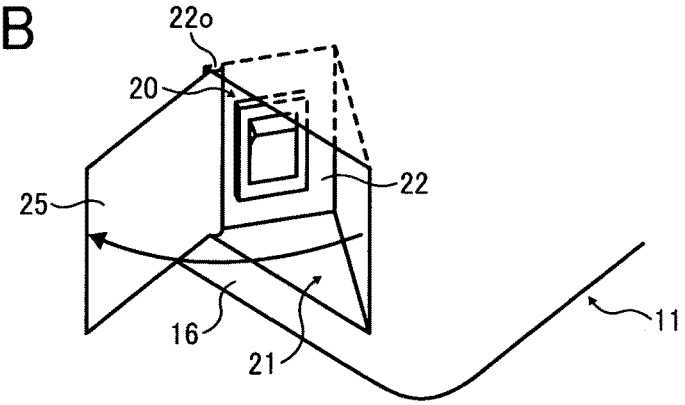
FIG. 8B is a perspective view illustrating vicinity of the power switch in which a cover switch is attached.
Figure 8C:
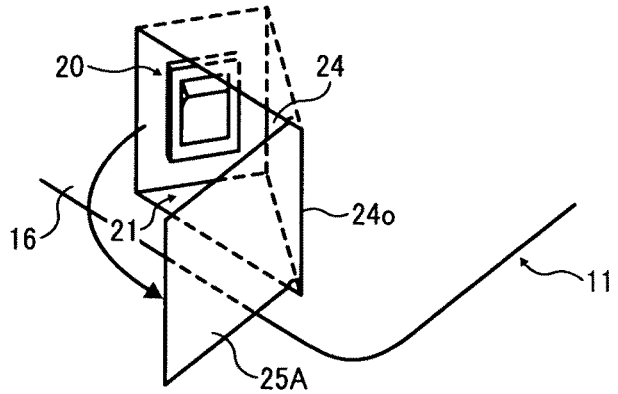
FIG. 8C is a perspective view illustrating vicinity of the power switch in which a variation of a cover switch is attached.
Figure 8D:
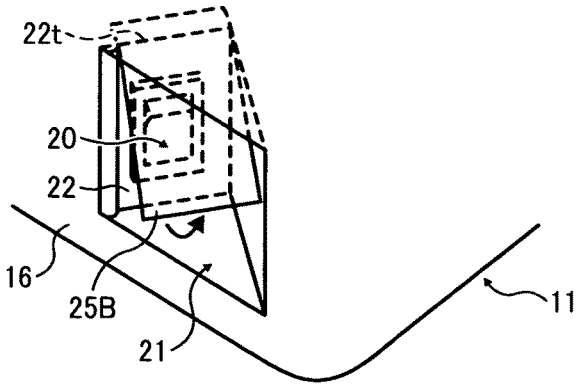
FIG. 8D is a perspective view illustrating vicinity of the power switch in which another variation of a cover switch is attached.

FIGS. 8B through 8D are perspective views illustrating the structure in the vicinity of the power switch 20 in which a switch cover is attached.

The switch cover is not attached to the vicinity of the power switch 20 shown in FIG. 8A. By contrast, in a variation of the structure of the vicinity of the power switch 20 shown in FIG. 8B, a switch cover 25 is attached to an opening edge 22*o* of the distal sloped surface 22 in the recess 21 such that the switch cover 25 can pivot around the opening edge 22*o* in horizontal direction or an almost horizontal direction of the printer body 11. In FIG. 8B, the switch cover 25 opens the opening of the recess 21 by pivoting backward of the printer body 11 around the opening edge 22*o* and closes the opening of the recess 21 by pivoting frontward.

The advantageous of the attachment of the switch cover 25 is described below.

In the configuration shown in FIG. 8B, the color of the switch cover 25 can be set different from that of the operation portion 201 of the power switch 20 and the side surface 16 as the external material of the printer body 11, thereby enabling the user to easily recognize the switch cover 25 and not confuse it with the power switch 20. In addition, the power switch 20 is located inside of the switch cover 25, that is, the user does not see the power switch 20 from outside until the switch cover 25 is opened, and therefore, the appearance of the printer body 11 can be streamlined.

Alternatively, as shown in FIG. 8C, a switch cover 25A may be attached to an opening edge 24*o* of the proximal sloped surface 24 in the recess 21, such that the switch cover 25 can pivot around the opening edge 24*o* in a horizontal direction or an almost horizontal direction of the printer body 11. However, in this configuration, when the switch cover 25A is opened, it is difficult for user to see the power switch 20 in the recess 21. Therefore, although such a structure is preferable to prevent the power switch 20 from being operated unintentionally, it is necessary to improve visibility by, for example, making the switch cover 25A transparent.

As another variation, shown in FIG. 8D, a switch cover 25B may be provided in a top edge 22*t* of the distal sloped surface 22 on which the power switch 20 is provided or be provided close to the top edge 22*t* of the distal sloped surface 22 such that the switch cover 25B can pivot around the top edge 22*t* in the vertical direction or almost vertical direction of the printer body 11. With this configuration, although it is preferable to prevent the power switch 20 from being turned on and off unintentionally, it is necessary to improve visibility by, for example, making the switch cover 25B transparent.

It is to be noted that the structure of the electric switching structure including the switch cover 25 (25A, 25B) in which the operation portion 201 of the power switch 20 is provided may be positioned at another place on the printer body 11.

Second Embodiment

Figure 9A:
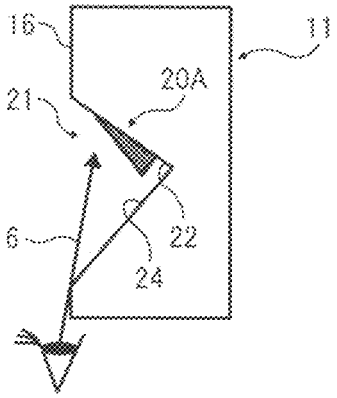
FIGS. 9A and 9B are cross-sectional views illustrating a vicinity of a power switch according to a second illustrative embodiment.
Figure 9B:
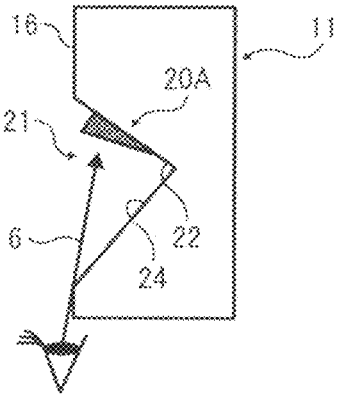

FIGS. 9A and 9B are cross-sectional diagrams illustrating a vicinity of a power switch 20A according to a second embodiment. In the second embodiment, the power switch 20A pivots on the central support in a horizontal or nearly horizontal direction of the printer body 11.

In this configuration, the power supply is off state when the power switch 20A pivots backward in the recess 21. If the power supply is on state in a state as shown in FIG. 9B, it is difficult for user to see the power switch 20A in the recess 21 from outside.

Third Embodiment

Figure 10:
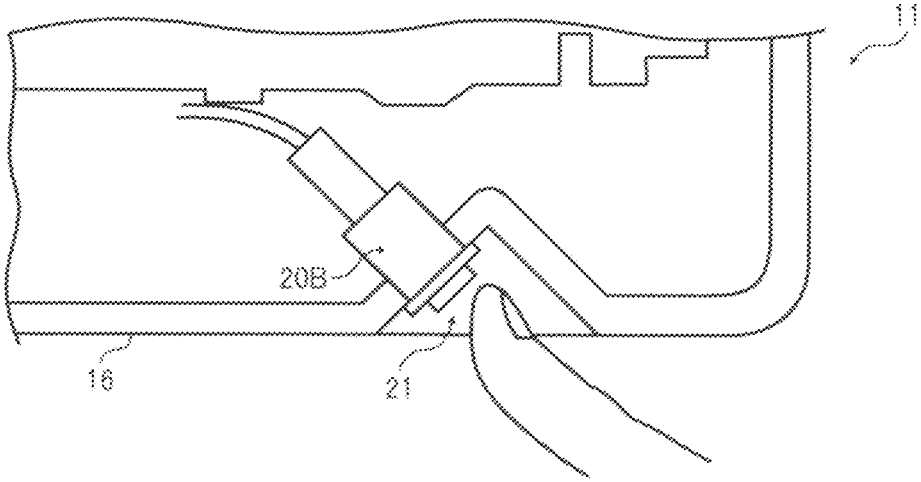
FIG. 10 is a cross-sectional view illustrating a vicinity of a power switch according to a third illustrative embodiment.

FIG. 10 is a cross-sectional view illustrating a vicinity of a power switch 20B according to a third embodiment. The power switch 20B according to the third embodiment is a push-type switch that moves reciprocally vertically to or almost vertically to the distal sloped surface 22 of the recess 21. The power switch 20B is provided on the distal sloped surface 22 of the recess 21, which facilitates operating and improves visibility, differing from a comparative example in which a push type power switch is provided in a square recess formed in the side face of the printer body.

Fourth Embodiment

Herein, the above-described power switch structure can be used for not only image forming apparatuses (printer) but also various apparatuses, such as shredders and so on. A fourth embodiment of the switch structure included in a shredder is described below.

Figure 11:
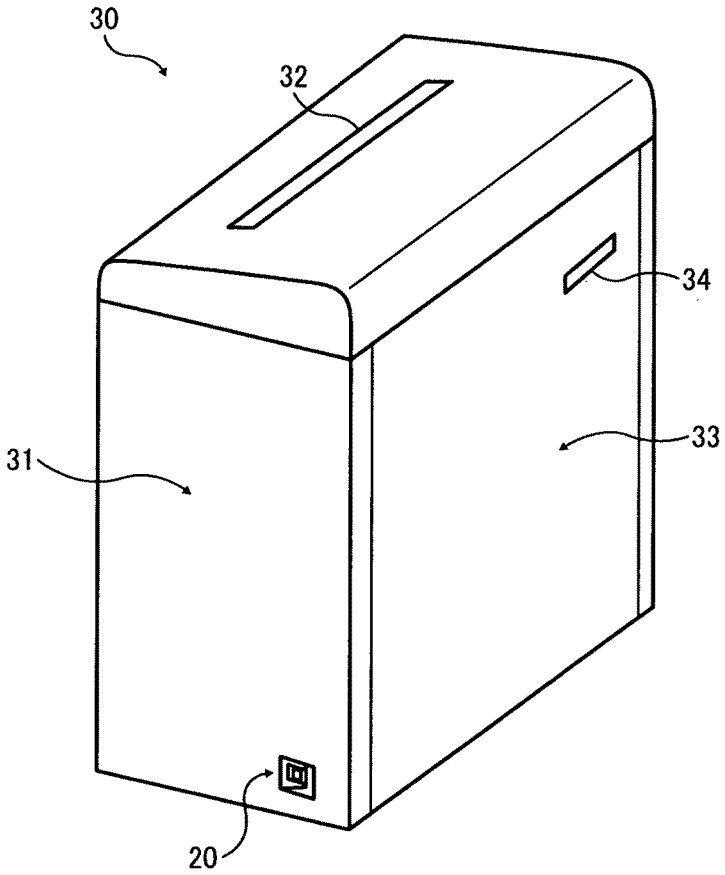
FIG. 11 is a perspective view illustrating a shredder including the vicinity of the power switch shown in FIG. 5A.

FIG. 11 is a perspective view illustrating a shredder 30 in which the above-described power switch 20 is provided. In FIG. 11, reference numeral 31 represents a shredder body, 32 represents a paper slot through which papers to be shredded is inserted, 33 represents a front door, and 34 represents a door handle. With this configuration, when the user opens the front door 33 while putting his (her) hand on the door handle 34, the user can extract the cut papers from the shredder body 31.

Although FIG. 11 shows the configuration in which the power switch 20 is provided in a left side surface of the shredder body 31, the position of the power switch 20 is not limited on the left side surface, the power switch 20 can be provided on a right side surface of the shredder body 31. In addition, the configuration of the switch structures shown in FIG. 5A through FIG. 10 can be also used for the power switch included in the shredder 30.

Numerous additional modifications and variations are possible in light of the above teachings. It is therefore to be understood that, within the scope of the appended claims, the disclosure of this patent specification may be practiced otherwise than as specifically described herein.

What is claimed is:

1. A power switch structure for an apparatus, comprising:

a V-shaped recess, having a distal sloped face facing a front side of the apparatus and a proximal sloped face, provided in a lateral side of the apparatus; and a power switch, inclined with respect to the side surface of the apparatus, positioned on the distal sloped face of the V-shaped recess and facing the front side of the apparatus.

2. The structure according to claim 1, wherein the power switch pivots within the V-shaped recess.

3. The structure according to claim 2, further comprising a rotary shaft around which the power switch pivots thereof within the V-shaped recess.

4. The structure according to claim 2, wherein the switch is a rocker-type switch.

5. The structure according to claim 1, wherein the power switch pivots substantially vertically within the V-shaped recess.

6. The structure according to claim 5, further comprising a rotary shaft around which the power switch pivots substantially vertically within the V-shaped recess.

7. The structure according to claim 5, wherein the switch is a rocker-type switch.

8. The structure according to claim 1, wherein the power switch moves reciprocally back and forth within the V-shaped recess and with respect to the distal sloped face surface of the V-shaped recess.

9. The structure according to claim 1, wherein the power switch is a push-type switch.

10. The structure according to claim 1, further comprising a switch cover hinged to the apparatus and disposed over the opening of the V-shaped recess.

11. The structure according to claim 10, wherein the switch cover swings substantially horizontally to open and close the V-shaped recess.

12. The structure according to claim 10, wherein the switch cover swings substantially vertically to open and close the V-shaped recess.

13. An image forming apparatus, comprising:

an apparatus body;

a V-shaped recess, having a distal sloped face facing a front side of the apparatus and a front face, provided in one side of the apparatus body; and a power switch, inclined with respect to the side surface of the apparatus body, provided on the distal sloped face of the V-shaped recess and facing the front side of the apparatus body.

14. The structure according to claim 6, further comprising a pivotable plate including a movable contacting portion.

15. The structure according to claim 14, wherein the movable contacting portion contacts and separates from a fixed contacting portion provided on an upper face of supporting terminals.

16. The structure according to claim 15, wherein when the movable contacting portion contacts the fixed contacting portion, the supporting terminals conduct electricity to each other to so that the power switch is at an ON state.

17. The structure according to claim 11, wherein the switch cover is attached to an opening edge of the distal sloped surface in the V-shaped recess.

18. The structure according to claim 12, wherein the switch cover is attached to a top edge of the distal sloped surface in the V-shaped recess.

19. The structure according to claim 10, wherein a color of the switch cover is different than a color of the power switch.

20. The structure according to claim 10, wherein a color of the switch cover is different than a color of the side surface of the apparatus.

* * * * *